US005191775A

United States Patent [19]

Shiina et al.

[11] Patent Number: 5,191,775

[45] Date of Patent: Mar. 9, 1993

[54] REFRIGERANT RECEIVER

[75] Inventors: Kanichi Shiina; Katsuhisa Suzuki; Yuji Yamamoto, all of Tochigi, Japan

[73] Assignee: Showa Aluminum Corporation, Osaka, Japan

[21] Appl. No.: 860,565

[22] Filed: Mar. 30, 1992

Related U.S. Application Data

[63] Continuation of Ser. No. 663,084, Mar. 1, 1991, abandoned, which is a continuation-in-part of Ser. No. 428,672, Oct. 30, 1989, abandoned.

[30] Foreign Application Priority Data

Oct. 31, 1988 [JP] Japan ..... 63-142822

[51] Int. Cl.[5] ..... F25B 43/00

[52] U.S. Cl. ..... 62/503; 215/364

[58] Field of Search ..... 62/503, 509; 220/309, 220/310, 362; 215/31, 355, 364; 29/516

[56] References Cited

U.S. PATENT DOCUMENTS

| | | | |
|---|---|---|---|
| 402,627 | 5/1889 | Smith | 29/516 |
| 1,275,816 | 8/1918 | Williamson et al. | 215/364 X |
| 2,275,426 | 3/1942 | Gray | 220/309 X |
| 3,798,921 | 3/1974 | Scherer et al. | 62/503 X |
| 3,977,576 | 8/1976 | Amabile | 29/516 X |
| 4,226,334 | 10/1980 | Weiler et al. | 215/355 X |
| 4,783,897 | 11/1988 | Basnett | 29/516 X |
| 4,993,455 | 2/1991 | Yanagisawa | 62/509 X |

*Primary Examiner*—William E. Tapolcai
*Attorney, Agent, or Firm*—Nikaido, Marmelstein, Murray & Oram

[57] ABSTRACT

A refrigerant receiver includes a tubular body having a bottom and an open upper end portion, and a closure fitted in the open end portion. The open end portion is constricted and crimped by electromagnetic forming and thereby secured to the closure.

21 Claims, 6 Drawing Sheets

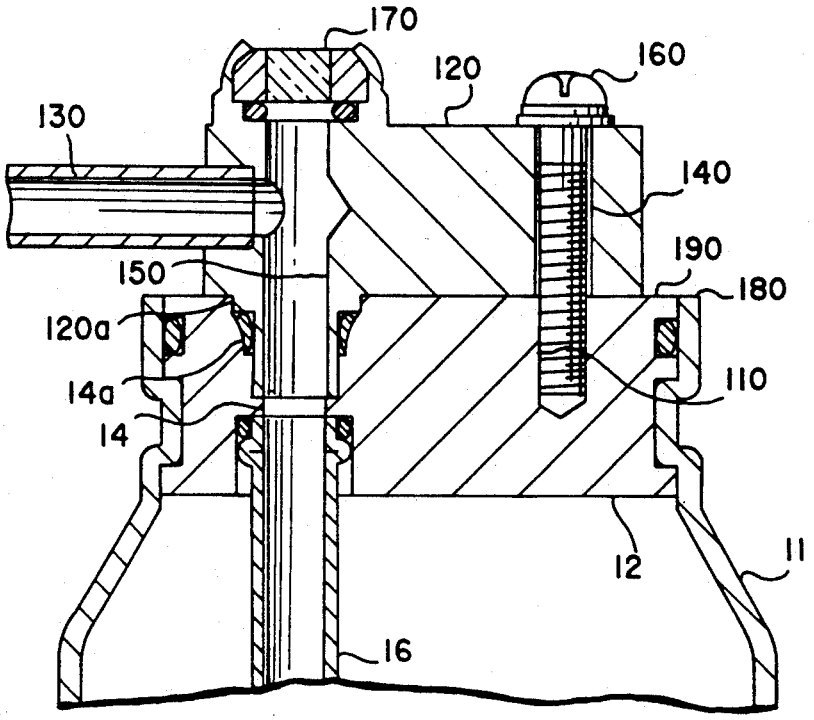
Fig.12(A)
Fig.12(B)
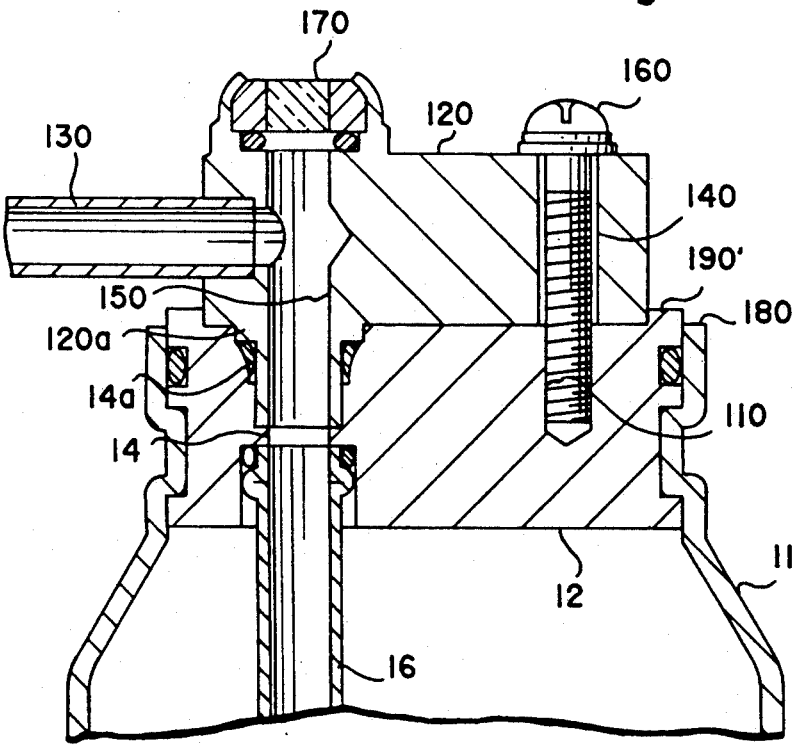

REFRIGERANT RECEIVER

BACKGROUND OF THE INVENTION

The present invention relates to refrigerant receivers for use in motor vehicle air conditioners and the like.

Conventional refrigerant receivers comprise a body and a closure welded to the body regardless of whether the receiver is made of iron or aluminum.

The conventional receiver, which requires welding, has the problems of necessitating a time-consuming fabrication procedure and a skilled worker, taking some time to check the weld for leaks and failing to exhibit a very esthetic appearance.

SUMMARY OF THE INVENTION

The main object of the present invention is to provide a refrigerant receiver which is free of the above problems.

The present invention provides a refrigerant receiver which comprises a tubular body having a bottom and an open upper end portion, and a closure fitted in the open end portion, the open end portion being constricted and crimped by electromagnetic forming and thereby secured to the closure. Thus, there is no need to resort to welding for joining the closure to the body.

Since the closure need not be welded to the body, the present invention has overcome all the problems mentioned above and attributable to welding. More specifically, the present receiver can be fabricated within a reduced period of time without necessitating a skilled worker and checking of the weld for leaks, has an esthetic appearance, and retains the desired strength since the body is free of the thermal influence due to welding. Because the refrigerant aspirator tube and the like to be accommodated in the body are also free of the thermal influence due to welding, the aspirator tube and the like, which are usually made, for example, of aluminum tubing, can be prepared from synthetic resin at a reduced cost. Furthermore, the body can be of a reduced wall thickness although this has been impossible if welding is resorted to.

BRIEF DESCRIPTION OF THE DRAWINGS

FIGS. 12(A) and 12(B) are fragmentary views showing a top of the closure.

DESCRIPTION OF THE PREFERRED EMBODIMENTS

Embodiments of the invention will be described below with reference to the drawings.

EMBODIMENT 1

Figure 1:
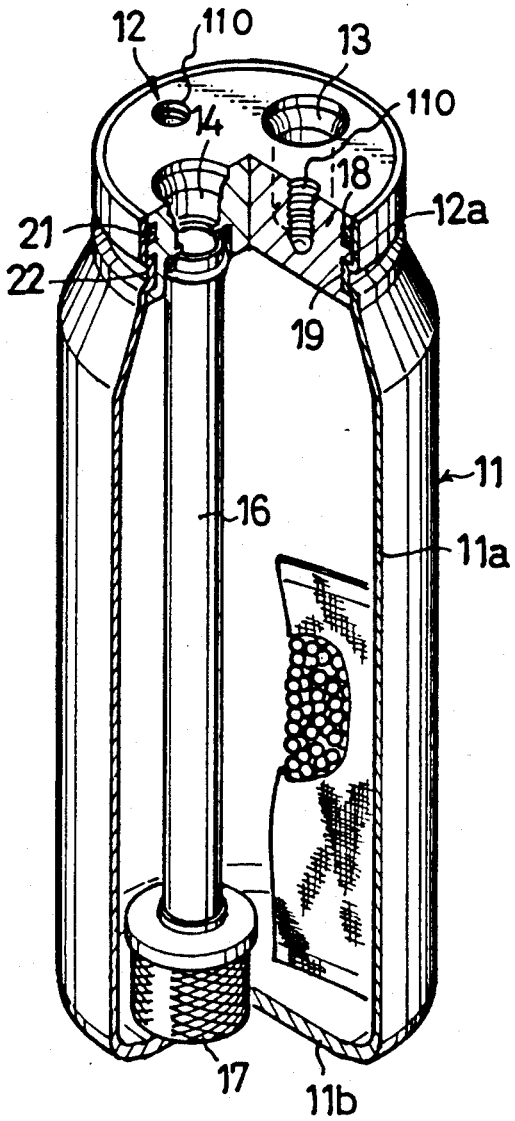
FIG. 1 is a perspective view partly broken away and showing a first embodiment of the invention.
Figure 2:
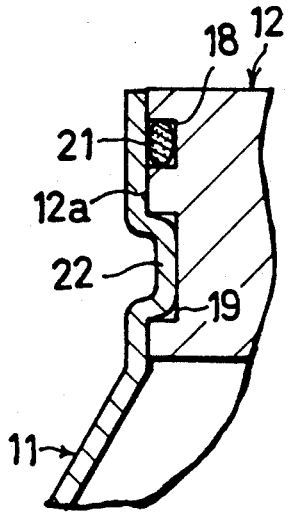
FIG. 2 is an enlarged fragmentary view in vertical section showing the same.

The refrigerant receiver shown in FIGS. 1 and 2 comprises a tubular body 11 having a bottom and made of an aluminum forging. The body 11 comprises a trunk wall 11*a* having an open upper end portion, and a bottom wall 11*b* provided at the lower end of the trunk wall and integral therewith. The open end portion of the trunk wall 11*a* is reduced in diameter and has fitted therein a closure 12 in the form of an extruded aluminum disk. The closure 12 has a refrigerant inlet channel 13 and a refrigerant outlet channel 14 both extending vertically therethrough and each having an upper open end to which an unillustrated pipe is connected by a connecting member. A refrigerant aspirator tube 16 has an upper end joined to the lower open end of the refrigerant outlet channel 14 and a lower end having a strainer 17 attached thereto. The refrigerant aspirator tube 16, which is made of an aluminum tube, may alternatively be made of synthetic resin. The closure 12 has a periphery 12*a* formed with an O-ring groove 18 and an annular recess 19 positioned below the groove 18. An O-ring 21 is fitted in the O-ring groove 18. The body 11 is formed with an inward annular engaging projection 22 C-shaped in cross section and fitted in the annular recess 19. The upper end portion of the body 11 is subjected to an electromagnetic forming process, whereby the engaging projection 22 is formed and the end portion is constricted and secured to the closure 12 as crimped.

Figure 3:
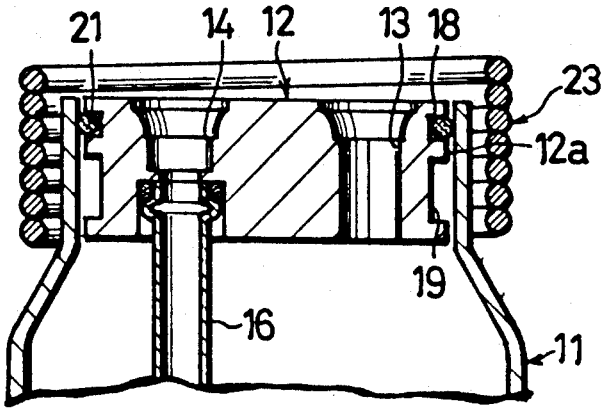
FIG. 3 is a view in section illustrating an arrangement for electromagnetic forming process.

FIG. 3 shows the body 11 and the closure 12 before being subjected to the electromagnetic forming process, and an electromagnetic forming coil 23. Before forming, the upper end portion of the body 11 is straight. When electricity of high voltage and high amperage is passed through the coil 23, the coil 23 produces a powerful magnetic field, whereupon a secondary current flows through the body 11 due to electromagnetic induction to set up a magnetic field also on the body 11. The two magnetic fields repel each other, whereby the body upper end portion is so deformed as to be constricted. At this time, the upper end portion of the body 11 is so deformed over a required width as to fit into the recess 19, whereby the annular projection 22 is formed.

Figure 11:
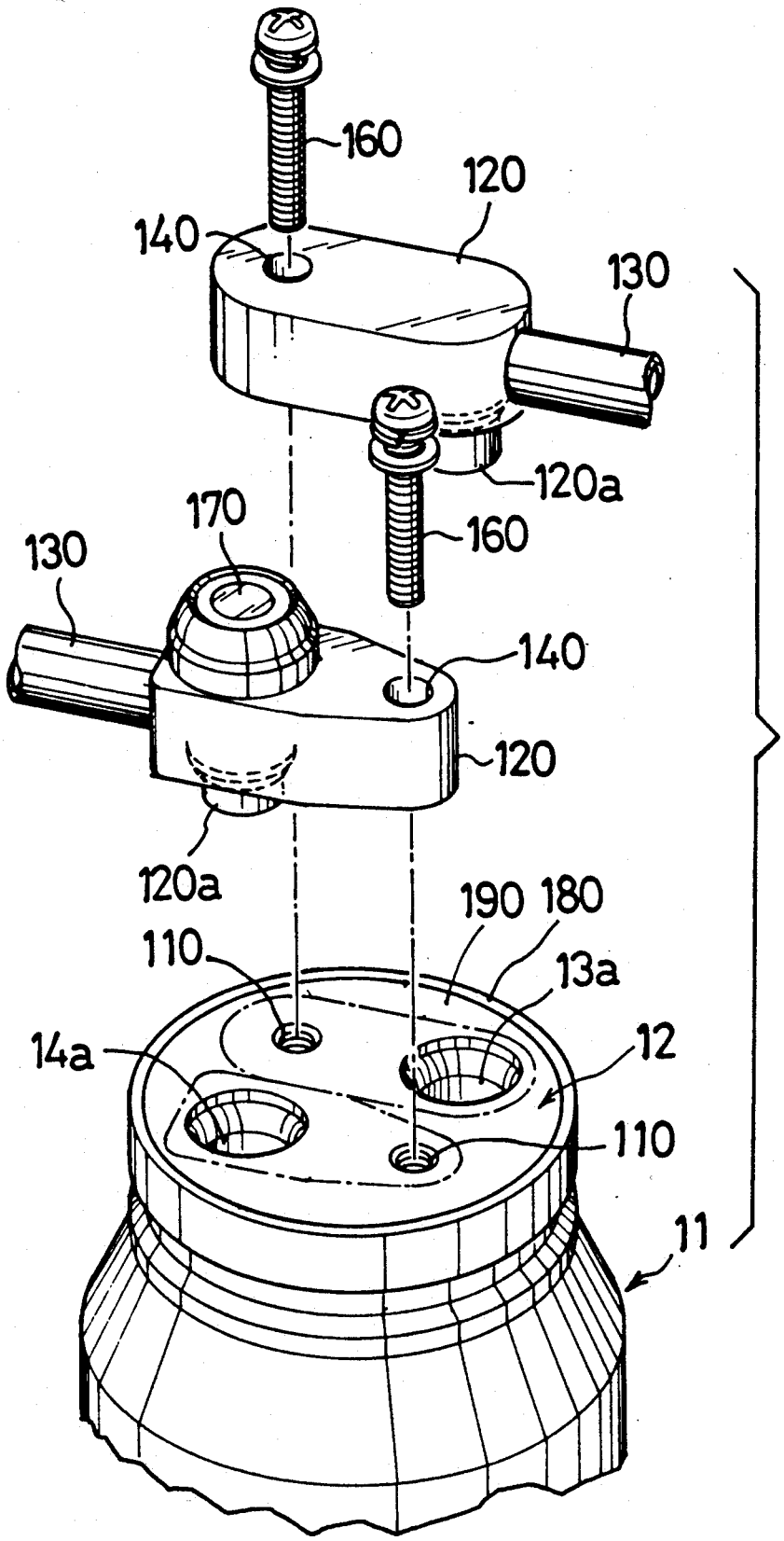
FIG. 11 is a fragmentary view showing connection of inlet and outlet channels.

FIGS. 11, 12(A) and 12(B) show two blocks 120 with holes 140 for connecting a refrigerant inlet channel 13 and a refrigerant outlet channel 14 to respective pipes 130. A refrigerant communication channel 150 and a bolt hole 140 are provided at the block 120. A bolt 160 is screwed in a tapper hole 110 through a hole 140 so that the block 120 is fixed to the upper surface of a closure 12. The upper open end of the refrigerant communication channel 150 is closed by a sight glass 170. The upper surface 190, 190' of closure 12 is flat. The upper surface 190, 190' is either even (190) or slightly higher (190') than the upper lip 180 of body 11, so that the block 120 is easily installed on the upper surface 190, 190' of the closure. Bolts 160 are used to install the blocks 120 on the upper surface of closure 12.

An enlarged diameter portion 14*a* is formed at an upper end portion of a refrigerant outlet channel 14. A fitting cylinder 120*a*, which is fit in the enlarged diameter portion 14*a*, is formed downwardly in the form of projection at the end of a channel 150 of a block 120. An enlarged diameter portion 13*a* is formed at an upper end portion of a refrigerant inlet channel 13. A fitting cylinder 120*a* which is fit in the enlarged diameter portion 13*a* is formed downwardly in the form of projection at the end of a channel 150 of the block 120. A bolt 160 is screwed in a threaded hole 110 of the closure 12 through a bolt hole 140 of the block 120. A pipe 130 is connected to the channel 150 of the block 120.

EMBODIMENT 2

Figure 4:
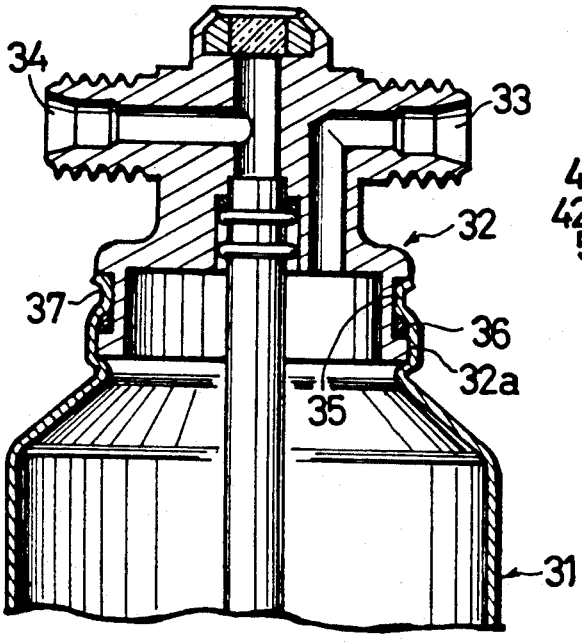
FIG. 4 is a fragmentary view in vertical section showing a second embodiment of the invention.

FIG. 4 shows another refrigerant receiver which comprises a tubular body 31 having a bottom, and a closure 32. The closure 32 is centrally formed on its upper side with pipe connecting externally threaded tubular portions 33 and 34 integrally therewith. The periphery 32*a* of the closure 32 is formed with an annular recess 35 only. An O-ring 36 is fitted in the annular recess 35. The outside diameter of the O-ring 36 is smaller than the width and depth of the annular recess 35. An engaging projection 37 is fitted in the recess 35, with the O-ring 36 positioned at the bottom lower portion of the recess 35. In the same manner as in the embodiment 1, the upper end portion of the body 11 is subjected to an electromagnetic forming process and is thereby constricted and so deformed as to form the engaging projection 37.

EMBODIMENT 3

Figure 5:
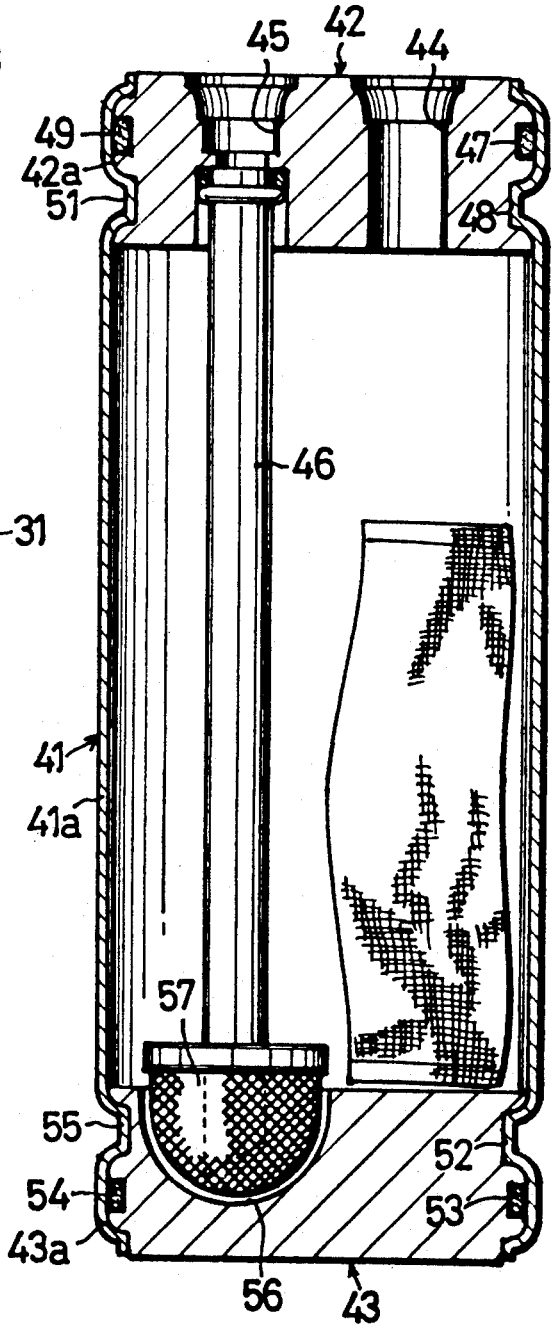
FIG. 5 is a view in vertical section showing a third embodiment of the invention.

With reference to FIG. 5, the illustrated receiver includes a body 41 which has a generally straight tubular trunk wall 41*a*. A top closure 42 and a bottom closure 43 are fitted in the upper and lower end portions of the trunk wall 41*a*, respectively. As in the embodiment 1, the top closure 42 is formed with a refrigerant inlet channel 44 and a refrigerant outlet channel 45, and a refrigerant aspirator tube 46 is in communication with the outlet channel 45. The top closure 42 is formed in its periphery 42*a* with an O-ring groove 47 and an upper annular recess 48 therebelow. An O-ring 49 is fitted in the groove 47, while an upper engaging projection 51 of the body 41 is fitted in the upper annular recess 48. The bottom closure 43 is formed in its periphery 43*a* with a lower annular recess 52 and an O-ring groove 53 therebelow. An O-ring 54 is fitted in the groove 53, and a lower engaging projection 55 of the body 41 in the lower annular recess 52. A semispherical cavity 56 is formed in the upper side of the bottom closure 43 and has fitted therein a strainer 57 attached to the lower end of the refrigerant aspirator tube 46.

EMBODIMENT 4

Figure 6:
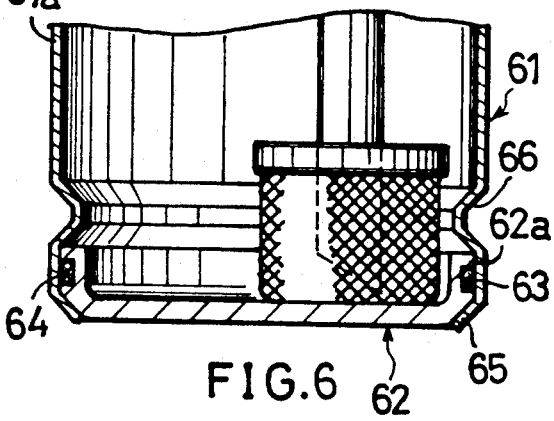
FIG. 6 is a fragmentary view in vertical section showing a fourth embodiment of the invention.

FIG. 6 shows another refrigerant receiver having a tubular body 61 the upper portion of which is not illustrated. The body 61 has a trunk wall 61*a* and is provided with a bottom closure 62 in the form of a shallow dish and fitted in the lower end portion of the wall 61*a*. The bottom closure 62 is formed in its periphery 62*a* with an O-ring groove 63 having an O-ring 64 fitted therein. The trunk wall 61a has a lower engaging projection 65 formed by inwardly bending the lower end portion of the wall having a required length from its lower extremity, and an upper engaging projection 66 spaced upward from the lower engaging projection 65 by a distance corresponding to the length of the peripheral surface 62*a* of the bottom closure 62. The bottom closure 62 has its peripheral edge clamped between the lower and upper engaging projections 65 and 66. Both the projections 65 and 66 are of course made by electromagnetic forming.

EMBODIMENT 5

Figure 7:
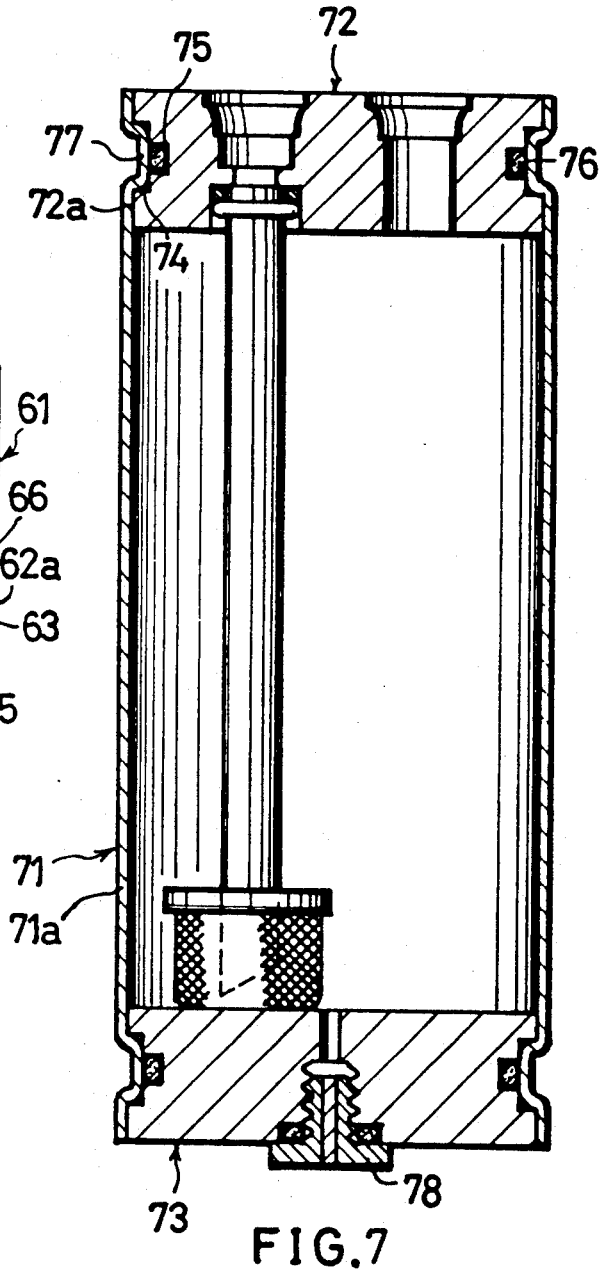
FIG. 7 is a view in vertical section showing a fifth embodiment of the invention.

With reference to FIG. 7, the illustrated receiver body 71, like the body of embodiment 3, has a generally straight tubular trunk wall 71*a* and is provided with a top closure 72 and a bottom closure 73 fitted in its upper and lower ends, respectively. The body 71, the top closure 72 and the bottom closure 73 basically have the same construction as those of the embodiment 3 and therefore will not be described. The top closure 72 is formed in its periphery 72*a* with an upper annular recess 74 and an O-ring groove 75 in the bottom of the recess 74. An O-ring 76 is fitted in the groove 75. The upper end portion, of the trunk wall 71*a* is constricted in the same manner as in the foregoing embodiments to thereby form an upper engaging projection 77, which is engaged in the upper annular recess 74 to close the opening of the O-ring groove 75 with the top portion of the projection 77. The bottom closure 73, like the top closure 72, is secured to the truck wall 71*a* by crimping the wall. A detailed description of this portion will not be given. A meltable plug 78 is screwed into the bottom closure 73.

EMBODIMENT 6

Figure 8:
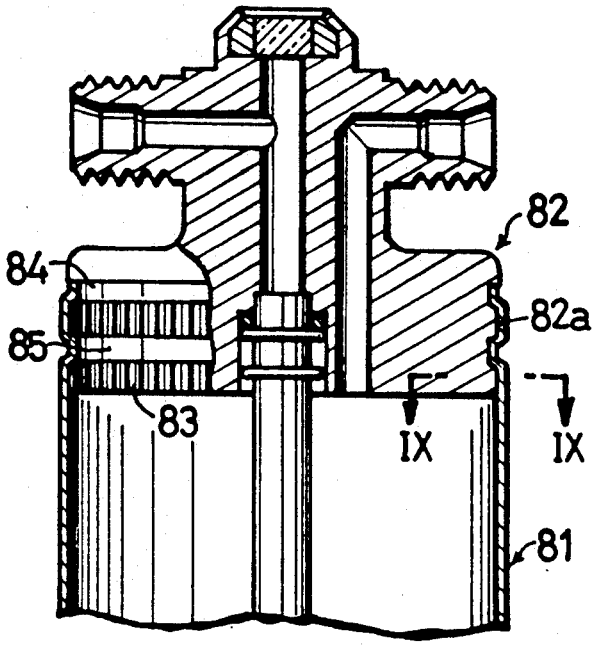
FIG. 8 is a fragmentary view in vertical section showing a sixth embodiment of the invention.
Figure 9:
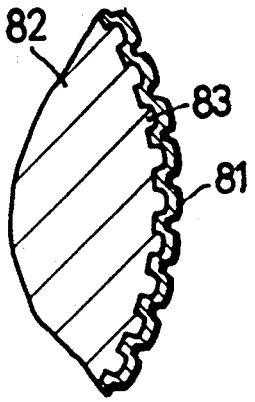
FIG. 9 is a fragmentary view in cross section of the sixth embodiment.

FIGS. 8 and 9 show another refrigerant receiver which, like the embodiment 2 of FIG. 4, comprises a tubular body 81 with a bottom, and a closure 82. Since these members have substantially the same construction as those of the embodiment 2, the difference between the two embodiments only will be described. The materials for the body 81 and the closure 82 are so selected that the closure 82 is harder than the body 81. Alternatively, the two members may be made of the same material, with the closure 82 only subjected to thermal hardening treatment. The periphery 82*a* of the closure 82 is corrugated by knurling in the form of waves in cross section as indicated at 83. The waves of corrugations 83 are formed over the entire circumference of the closure 82. The closure 82 has annular flat portions 84 and 85 immediately above the corrugated peripheral surface 82*a* and at the midportion of the height thereof, respectively. The flat portions 84, 85 are flush with the bottoms of the grooves of the corrugations 83. The upper end portion of the body 81 is constricted by electromagnetic forming so that the wall of the body 81 is engaged with the corrugations 83 and held in intimate contact with the flat portions 84, 85 on plastic deformation, whereby the joint between the body 81 and the closure 82 is made equivalent to the conventional weld joint in sealing property and mechanical strength.

EMBODIMENT 7

Figure 10:
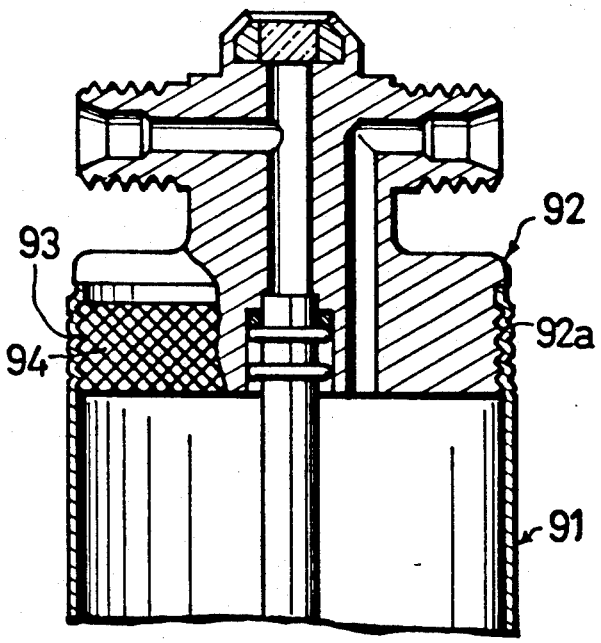
FIG. 10 is a fragmentary view in vertical section showing a seventh embodiment of the invention.

With reference to FIG. 10, the periphery 92*a* of a closure 92 is formed with lattice grooves 93 extending obliquely at angles of 45 degrees with a vertical line. The portions corresponding to lattice openings are flat as at 94. As in the embodiment 6, the upper end portion of a body 91 is constricted by electromagnetic forming so that the wall of the body 91 is engaged in the grooves 93 and held in intimate contact with the flat portions 94.

What is claimed is:

1. A refrigerant receiver comprising:

a tubular body having a trunk wall including an open upper end portion having a first diameter,
a lower portion having a second diameter which is larger than said first diameter, and
an intermediate tapered portion connecting said upper end portion and said lower portion; and a closure fitted in the open end portion, the open end portion being constricted and crimped, by electromagnetic forming, and therein secured to the closure, said closure having a flat upper surface which is one of even with and slightly higher than an upper surface of a lip of said tubular body, said closure having a refrigerant inlet channel extending therethrough, said refrigerant inlet channel having an enlarged inlet diameter portion formed in said flat upper surface of said closure at an upper end portion of said refrigerant inlet channel, and said closure having a refrigerant outlet channel extending therethrough, said refrigerant outlet channel having an enlarged outlet diameter portion formed in said flat upper surface of said closure at an upper end portion of said refrigerant outlet channel, and said closure having tapped holes formed in said flat upper surface for connection with auxiliary devices.

2. A refrigerant receiver as defined in claim 1 wherein the closure has a periphery conforming with an inner surface of the open upper end portion of the open upper and formed with an annular recess, and the body end portion is formed with an inward annular engaging projection by electromagnetic forming in corresponding relation to the annular recess, the engaging projection being engaged in the annular recess.

3. A refrigerant receiver as defined in claim 2 wherein the engaging projection is C-shaped in cross section.

4. A refrigerant receiver as defined in claim 2 wherein an O-ring groove is formed in a periphery of the closure on at least one of the upper and lower sides of the annular recess, and an O-ring is fitted in the groove.

5. A refrigerant receiver as defined in claim 1 wherein a refrigerant aspirator tube of synthetic resin is connected to a lower open end of the refrigerant outlet channel.

6. A refrigerant receiver as defined in claim 1 wherein the tubular body comprises a bottom wall provided at a lower end of the trunk wall and integral therewith.

7. A refrigerant receiver as defined in claim 1 wherein said closure is disk shaped.

8. A refrigerant receiver according to claim 1 wherein said auxiliary devices are two blocks installed on the upper surface of the closure with bolts.

9. A refrigerant receiver according to claim 8 wherein said two blocks each having communication channel for connection to one of said refrigerant inlet or outlet channels.

10. A refrigerant receiver as claimed in claim 8 wherein said two blocks each have bolt holes extending therethrough.

11. A refrigerant receiver as claimed in claim 10 wherein said bolts are screwed into said tapped holes of said closure through said bolt holes of said two blocks, wherein said two blocks are fixed to said upper surface of said closure.

12. A refrigerant receiver as claimed in claim 9 wherein one of said communication channels having an open upper end closed by a sight glass.

13. A refrigerant receiver as claimed in claim 9 wherein each block having a fitting cylinder formed downwardly in a form of a projection, said fitting cylinder formed downwardly in a form of a projection, said fitting cylinder formed at a lower end of said communication channel, said fitting cylinder fitting into one of said enlarged inlet or outlet diameter portion in said closure.

14. A refrigerant receiver as claimed in claim 9 wherein each communication channel being connected at a side of said block to a respective pipe.

15. A refrigerant receiver comprising:

a tubular body having a trunk wall including
an open upper portion having a first diameter,
a lower portion having a second diameter which is larger than said first diameter, and
an intermediate tapered portion connecting said open upper end portion and said lower portion; and a closure fitted in the open end portion, the open end portion being constricted and crimped, by electromagnetic forming, and therein secured to the closure, said closure having a flat upper surface which is one of even with an slightly higher than an upper surface of a lip of said tubular body, said closure having a refrigerant inlet channel extending therethrough, said refrigerant inlet channel having an enlarged inlet diameter portion formed in said flat upper surface of said closure at an upper end portion of said refrigerant inlet channel, said closure having a refrigerant outlet channel extending therethrough, said refrigerant outlet channel having an enlarged outlet diameter portion formed in said flat upper surface of said closure at an upper end portion of said refrigerant outlet channel, and said closure having tapped holes formed in said flat upper surface, and two blocks being installed on said upper surface of the closure in said tapped holes with bolts, said two blocks being connected to one of said refrigerant inlet or outlet channels.

16. A refrigerant receiver according to claim 15 wherein said two blocks each having communication channels for connection to one of said refrigerant inlet or outlet channels.

17. A refrigerant receiver as claimed in claim 15 wherein said two blocks each have bolt holes extending therethrough.

18. A refrigerant receiver as claimed in claim 17 wherein said bolts are screwed into said tapped holes of said closure through said bolt holes of said two blocks, wherein said two blocks are fixed to said upper surface of said closure.

19. A refrigerant receiver as claimed in claim 16 wherein one of said communication channels having an open upper end closed by a sight glass.

20. A refrigerant receiver as claimed in claim 16 wherein each block having a fitting cylinder formed downwardly in a form of a projection, said fitting cylinder formed at a lower end of said communication channel, said fitting cylinder fitted into one of said enlarged inlet or outlet diameter portion in said closure.

21. A refrigerant receiver as claimed in claim 16 wherein each communication channel being connected at a side of said block to a respective pipe.

* * * * *